United States Patent [19]

Hillbish et al.

[11] Patent Number: 5,074,039

[45] Date of Patent: Dec. 24, 1991

[54] METHOD OF MANUFACTURING ELECTRICAL CONNECTORS

[75] Inventors: Warren C. Hillbish, Hummelstown; Emad K. Ibrahim, York; John W. Kaufman, Hershey; Thomas J. Lynch, Mechanicsburg, all of Pa.

[73] Assignee: AMP Incorporated, Harrisburg, Pa.

[21] Appl. No.: 604,555

[22] Filed: Oct. 26, 1990

[51] Int. Cl.[5] ..... H01R 43/16

[52] U.S. Cl. ..... 29/883; 29/889; 439/344

[58] Field of Search ..... 29/826, 884, 883, 827; 439/344

[56] References Cited

U.S. PATENT DOCUMENTS

| | | | |
|---|---|---|---|
| 3,252,206 | 5/1966 | Stevens | 29/884 |
| 4,045,114 | 8/1977 | Dechelette | 29/884 X |
| 4,337,574 | 7/1982 | Hughes et al. | 29/884 X |
| 4,380,119 | 4/1983 | Normann et al. | 29/884 |
| 4,445,736 | 5/1984 | Hopkins | 29/827 X |
| 4,586,254 | 5/1986 | Ammon et al. | 29/884 |
| 4,611,262 | 9/1986 | Galloway et al. | 361/421 |
| 4,628,597 | 12/1986 | Meehan et al. | 29/884 X |
| 4,675,989 | 6/1987 | Galloway et al. | 29/622 |
| 4,772,761 | 9/1988 | Ibrahim et al. | 174/52 FP |
| 4,806,117 | 2/1989 | Johnston | 439/344 |
| 4,817,283 | 4/1989 | Johnston et al. | 29/884 |
| 4,869,672 | 9/1989 | Andrews, Jr. | 439/60 |

*Primary Examiner*—Carl J. Arbes

*Attorney, Agent, or Firm*—Katherine A. Nelson

[57] ABSTRACT

A method for manufacturing electrical connectors (22) which include rows of contact members (78, 90) held in a housing (24) includes feeding contact members in a wire form in parallel (74, 90), trimming such contact members to provide a partial form therefore at a trim station A, insert-molding such contact members to form a housing (62) and provide a carrier to tie such contact members together at a station (B), trimming said contact members to appropriate lengths, forming said contact members at further stations (C, D) into a multiple contact connector with rows of contact members in common planes held by the housing formed by insert-molding. Stamped and formed contact members (78', 90') are also contemplated utilized in an alternative method and both methods contemplate plating of the contact members either prior to molding or thereafter in alternative constructions, facilitated partially by the forming of the contact members into common planes.

16 Claims, 11 Drawing Sheets

12
18
20
Y
30
39
14
32
16
34
38
10
41
34
22
41
101
24
101
104
106
26
40
108
28
X
102
108
106
104
106

METHOD OF MANUFACTURING ELECTRICAL CONNECTORS

This invention relates to a method of manufacturing electrical connectors of a type having relatively large numbers of contacts on relatively small center-to-center spacings.

BACKGROUND OF THE INVENTION

The trend in packaging of electronic circuits fueled by integrated circuits has led to center spacings between circuit paths, traces, and contacts being reduced many times over. Thus, center-to-center spacings of 0.150 inches have been halved and halved again until center spacings of 0.025 inches are demanded. These relatively small dimensions require relatively small electrical contacts, housings, and assembly techniques; the very smallest increasing the cost of manufacturing tooling, jigs, fixtures, and the like. The ability to reduce the trace and contact pad sizes on circuit boards, which is done essentially by lithography, has proven to be less of a problem that the manufacture of associated connectors which are formed by traditional tools and techniques and carry tolerances inimicable to the present design trends of spacing dimensions.

A number of U.S. Patents purport to deal with the problem and one such is U.S. Pat. No. 4,869,672. In that patent, a circuit board connector, sometimes called a card edge connector, utilizes a double row of contacts staggered to provide very close centers in a linear sense along the length of the connector. The patent teaching is to provide interconnection of conductive pads on different centerline spacings as between a daughter board plugged into the connector and the mother board upon which the connector rests. The contacts of the connector end in spring fingers engaging the conductive pads on the daughter board on one end and on the other end in tabs which are plugged into the holes of a circuit board and soldered thereto The connector is manufactured by traditional methods in that the contacts are stamped and formed and then assembled into a molded housing.

An object of the present invention is an improved method of manufacture for electrical connectors having close centerline spacings and high numbers of contacts therein.

A further object of the invention is the provision of manufacturing electrical connectors in a way that assures accurate spacing of the contacts thereof in multiple in a low cost manner.

The invention has as a still further object of the provision of an electrical connector utilizing either drawn wire for contacts or stamped contacts trimmed, formed, and insert molded in multiple to provide a connector assembly.

SUMMARY OF THE INVENTION

The present invention achieves the foregoing objectives by providing a connector having an upper molded housing with projections to position and mount the connector on a mother board and to receive and position and hold a daughter board in relation thereto. Lower housings carry contact members having contact portions which extend within the upper housing to provide an interconnection to a daughter board inserted therein and further contact portions extending to a mother board thus interconnecting conductive paths from daughter board to mother board. The lower portions of the housing are insert-molded around contact members fed in multiple and in strip form to a molding station. In one embodiment, the contact members are made of drawn wire nickel plated and then partially formed while still in an unbroken end-to-end relationship with a second step of being insert-molded in multiple and thereafter plated, further formed, and in certain instances, plated again. During the molding step, in addition to molding housings carrying the contacts, the molding is attached to a separate carrier strip which facilitates transport of the series of insert-molded housings along the production process. The various forming stations result in the contact members having their particularized configuration with one end thereof made into a U-shaped spring for engagement with the contact pads of the daughter board and the other ends of the contact members formed into solder tabs adapted to be soldered to the mother board contact pads. It is contemplated that gold may be selectively applied to the contact areas associated with interconnection to contact pads of daughter boards and solder in the form of tin lead plating or coating applied to the solder tab ends, preferably after the lower portion or subassemblies of the connectors are in their assembled and formed state. As an alternative, the method contemplates a method wherein the contacts are stamped and formed and may be preplated selectively to provide contact areas of gold and solder on solder tails.

IN THE DRAWINGS

DETAILED DESCRIPTION OF THE INVENTION

Figure 1:
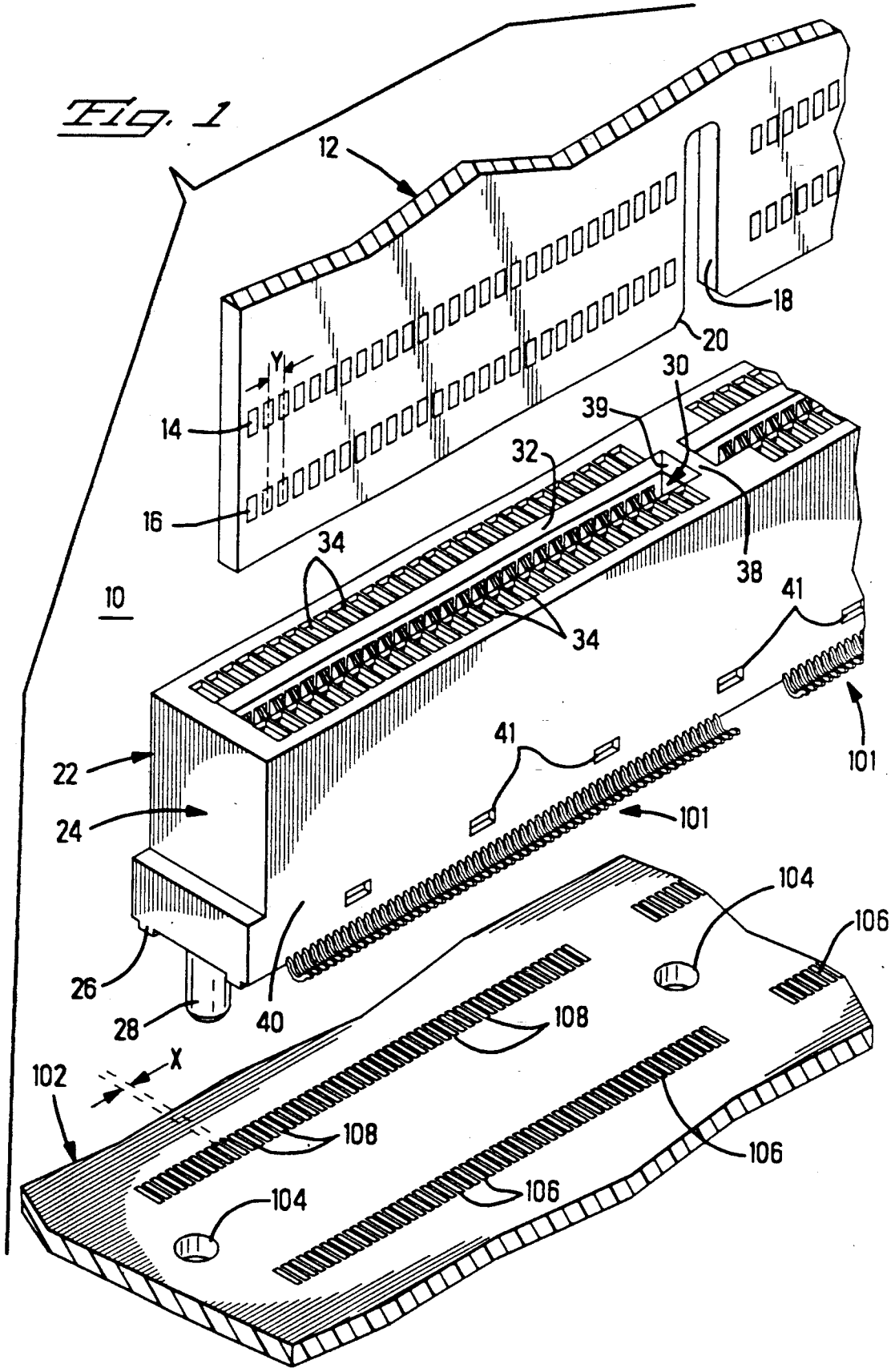
FIG. 1 is an exploded view showing portions of an assembly including a daughter board, a connector in accordance with the invention, and a mother board.
Figure 4:
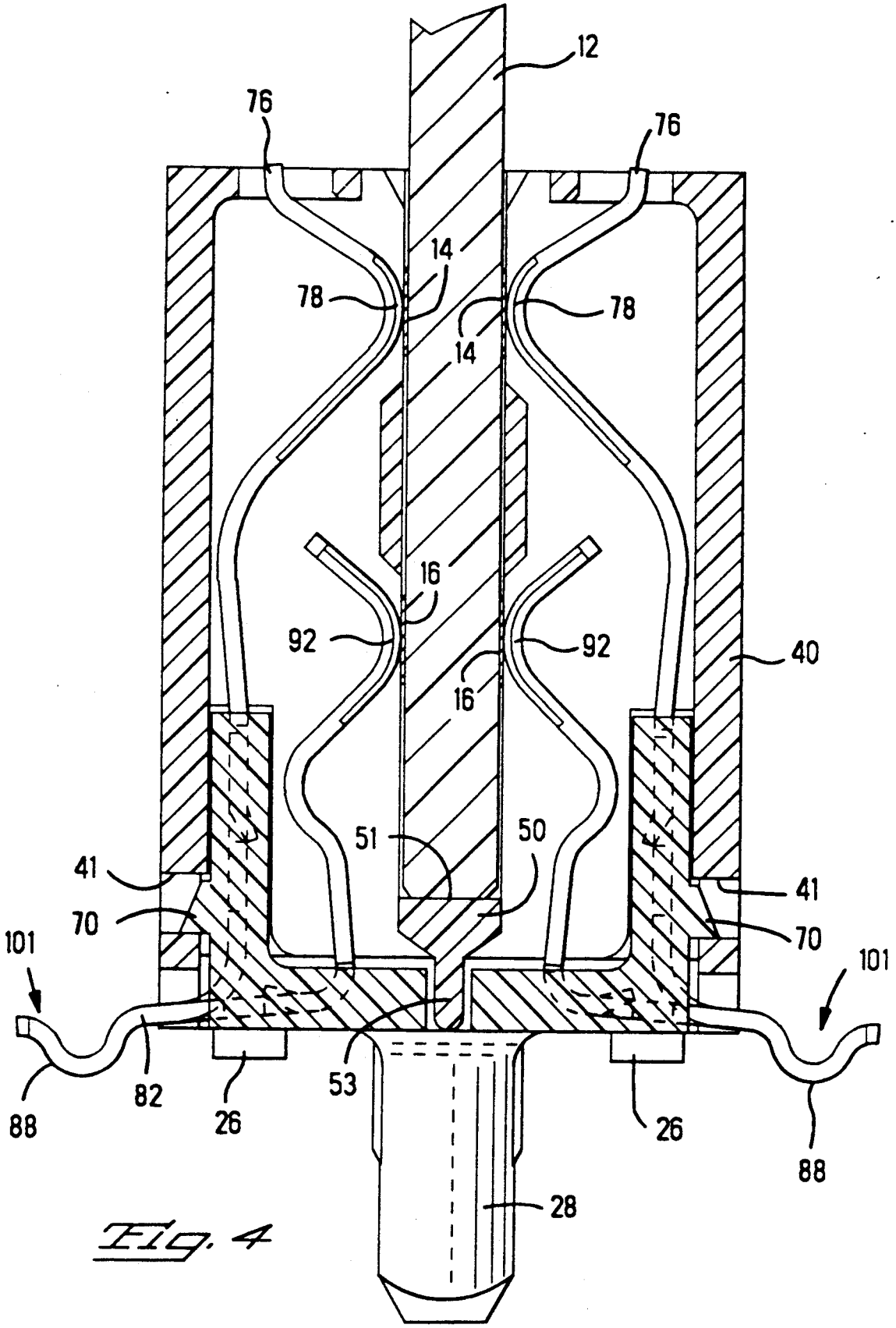
FIG. 4 is a view of the connector similar to that of FIG. 3 and further having the daughter board inserted therein.

FIG. 1 shows an assembly 10 including a daughter board 12, a connector 22, and a mother board 102 in an exploded view preparatory to assembly of the connector to the mother board and insertion of the daughter board into the connector. The daughter board 12 includes two rows of contact pads 14,16 on the major surfaces of the board 14, there being two similar rows of contact pads 14,16 on the other side as shown in FIG. 4. Conductive traces or circuits within the board (not shown) typically interconnect to components on the board which provide electronic functions and are interconnected to the mother board by the connector 22. Toward the center of the board 12 is a slot 18 beveled at 20, which aligns and positions board 12 relative to insertion into the connector 22 and engagement with wall 38 and associated beveled surface 39. The mother board 102 includes a series of apertures shown as 104 in FIG. 1 and first and second rows of contact pads shown as 106 and 108 disposed on the upper surface thereof. These contact pads interconnect to traces or circuits within laminations in the board and to other pads for interconnections to other daughter boards and to the input and output circuits associated with the mother board.

The connector 22 includes a housing 24 having a plurality of projections 26 on the bottom surface thereof, which serve as a standoff to allow cleaning of flux and other materials once the connector is soldered to the mother board. Projections 28 extend from the lower surface of the housing 24 and are shaped to fit within the apertures 104 of the mother board to position, align, and secure the mounting of connector 22 thereto. As can be seen in FIGS. 1 and particularly FIG. 2, the housing 24 includes a series of apertures 41 along the lower side wall surfaces thereof which serve to provide a latching of lower housing elements in a manner to be described.

Figure 2:
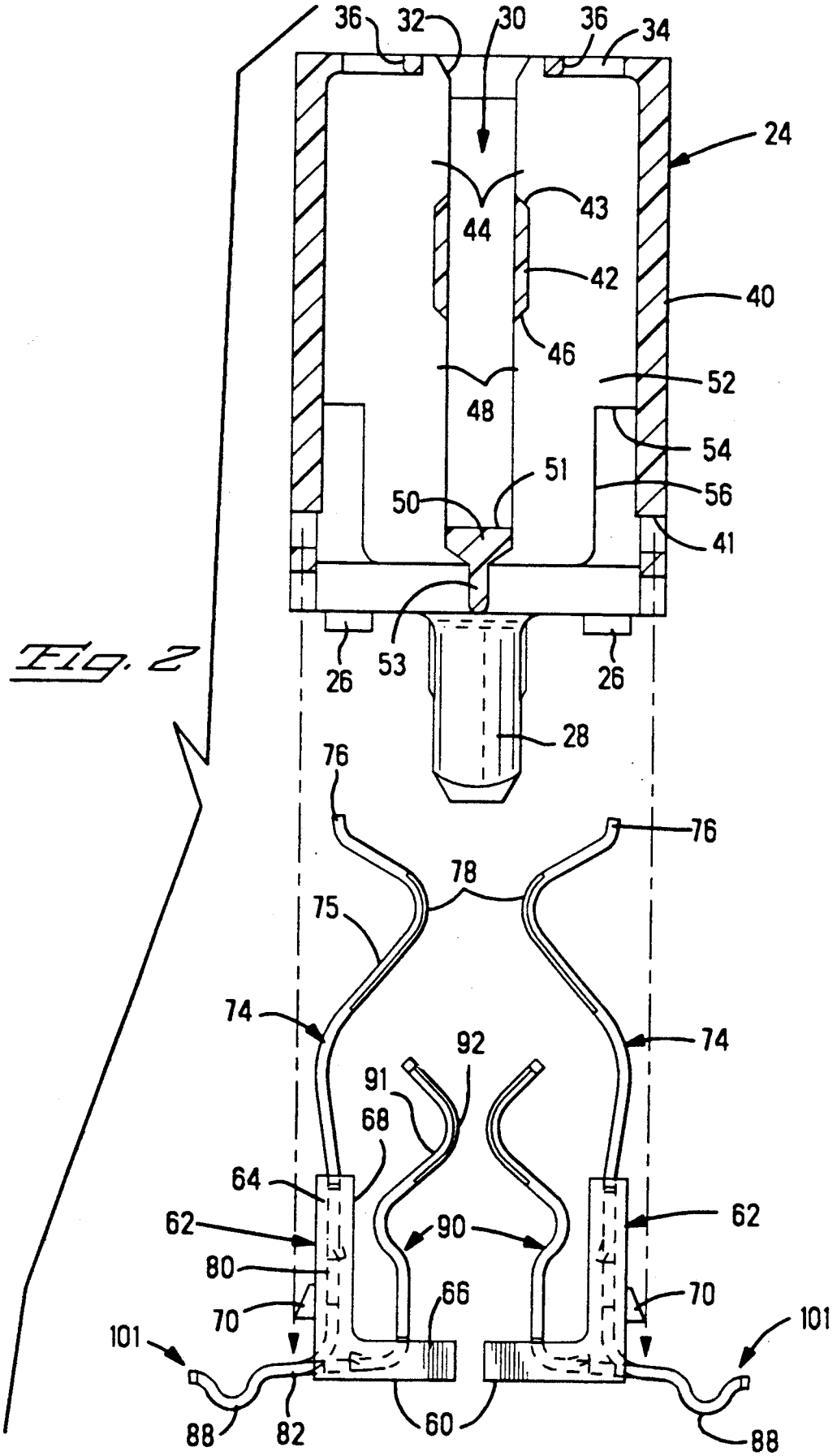
FIG. 2 is an exploded and partially sectioned view of the connector of the invention preparatory to assembly of the parts thereof.

Referring now to FIG. 2, an exploded cross-sectional view of the connector 22, the upper housing 24 includes interior walls 42 that extend longitudinally through the housing 24 and define slot 30 therebetween. Walls 42 are joined at the lower surface of housing 24 by bottom wall 50 having surface 51 which defines the lower end of slot 30. Each wall 42 includes upper and lower slots 44, 48 respectively which provide access to slot 30 for first and second contacts 74, 90 respectively. The lower end of slot 44 is defined by surface 43 which acts as a stop, as shown in FIG. 4, to limit inward movement of spring arm 75 first contact 74. The upper end surface 46 of slot 48 acts in a similar manner to limit the inward movement of spring arm 91 of second contact 90. Upon insertion of card 12 into slot 30, surface 50 operates as a stop to position board 12 in downward travel and thus locate the contact pads 14 and 16 thereon relative to contact springs in the manner shown in FIG. 5. The bottom housing wall 50 has a narrowing tip 53 which fits between the lower housing subassemblies 60 in the manner shown in FIG. 4. Each of the slots or apertures 34 leads to a cavity defined by a series of transverse walls 52 and the inner surface of the outer wall 40. Each wall 52 is configured at 54 in the manner shown in FIGS. 3 and 4 to receive an upper part of the lower housing subassemblies. A lower portion of wall 52 provides a bearing surface 56 in the manner shown in FIGS. 3 and 4 to hold the lower subassemblies of the housing in a vertical sense.

Figure 3:
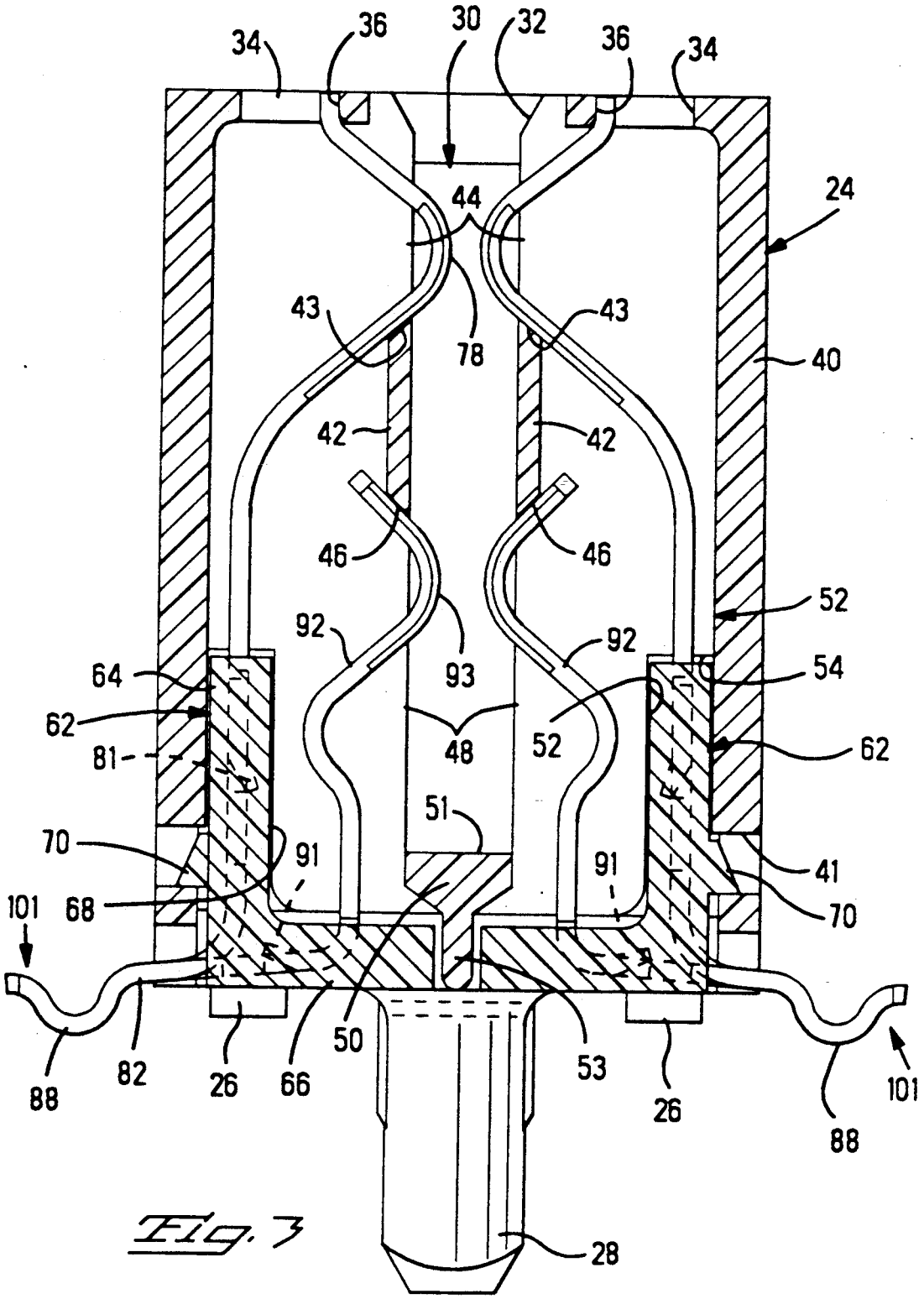
FIG. 3 is a cross sectional view of the assembled connectors of FIG. 2.

As also shown in FIG. 2, the housing 22 includes a pair of first and second lower subassemblies 60 comprised of housings 62 having first and second contact members 74, 90 secured therein. Housing 62 is comprised of a plastic body L-shaped in cross-section, including an upstanding or vertical portion 64 and a horizontal portion 66. The interior surface 68 of portion 64 is engaged by the interior wall 52 of the upper housing 24, shown on the right side of the view in FIG. 4. This holds or locks the lower housing portion 62 in a horizontal direction. As can be seen, the outside wall of 62 includes a beveled projection 70 which snaps into the corresponding apertures 41 in the side wall of the housing 24 as shown in FIGS. 1, 2, and 3. As can be seen from FIG. 3, the lower housings 62 and 100 of subassemblies 60 fit up within housing 24 and are latched therein by projections 70 which engage the apertures 41. Each of the housings 62 includes lower standoff projections 72 which operate to limit the downward displacement of the housings relative to the contact members and limit the deflection of such contact members, as shown in FIG. 3.

Figure 5:
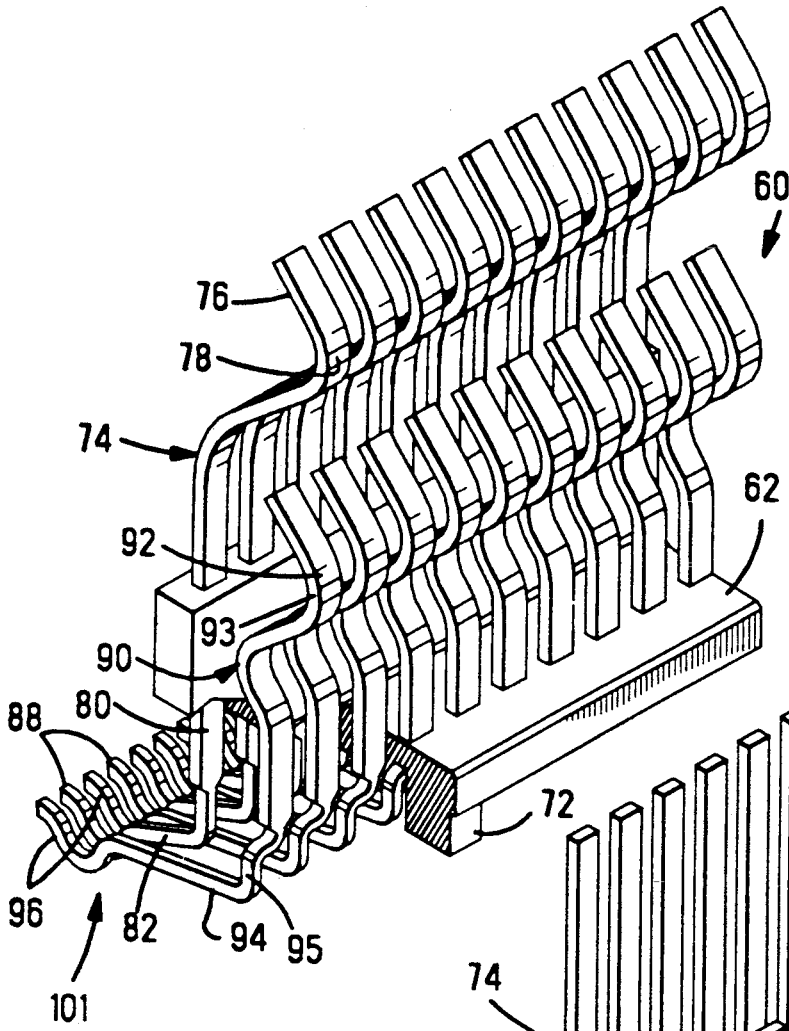
FIG. 5 is a perspective view of one-half of the lower portion of the connector of the invention assembled and formed in accordance with the invention.

Subassembly 60 can best be understood by referring to FIG. 5. Housing 62 includes a first row of contact members 74 having spring arm sections 75 with upper end 76 curled inwardly to define contact points 78 which engage upper contact pads 16 of a daughter card as shown in FIG. 5. Each of the first contact member 74 includes a lower portion 80 having an arm 82 that extends outwardly and curves downwardly as shown in FIG. 5 to define a solder tab 88. Solder tabs 88 preferably include a coating of solder thereon sufficient in thickness to bond the tab to a corresponding tab 108 on the mother board upon application of heat applied thereto. As is also shown in FIG. 5, a row of second contact members 90 are secured in housing 62 and are parallel to the row of first contact members 74. Contact members 90 have spring arms 91 having upper ends 92 curved inwardly to define contact areas or points 93. The lower portions of the second contact members 90 include a bend section 95 and an arm 94 leading to further solder tabs 96. By virtue of the bend section 95, the second contact of the solder tabs 96 of second contact members 90 are caused to be interdigitated with the solder tabs 88 of first contact members 74 to define an array 101 of outwardly extending solder tabs.

FIG. 3 shows the assembly of upper housing and lower housing elements and the various contacts, and FIG. 4 shows this assembly having a circuit board inserted therein so that the contact pads 14 and 16 in the two rows on board 12 engage and contact the contact members of the connector, contact points 78 and 92 which in turn lead to the solder tabs 88 and 96 and when such are soldered to the mother board contact pads, interconnect the circuits of the daughter board 12 to the circuits of the mother board 102. As can be discerned from FIG. 5, the contact members 74 and 90 have the contact surface ends 78 and 92 lying in a common plane extending longitudinally of the connector and further in a common plane extending transversely of the connector but with the solder tab ends of such contact members residing in a common plane extending longitudinally of the connector and parallel with the surface of the mother board but offset each to the other with respect to the transverse plane to provide the interdigitation. This, thereby, connects the two rows of contact pads on each side of the daughter board to one corresponding row of contact pads of the mother board, in essence doubling the density of interconnections for a given linear dimension of the connector and the daughter board relative to the mother board. As can be appreciated, the various contact members of the connector of the invention are on very close centers such as 0.025 inches for the solder tabs and 0.050 inches for each of the rows comprised of contacts 74 and 90. These features and advantages are discussed more fully in Application Serial Number filed concomitantly with the present application.

Figure 8:
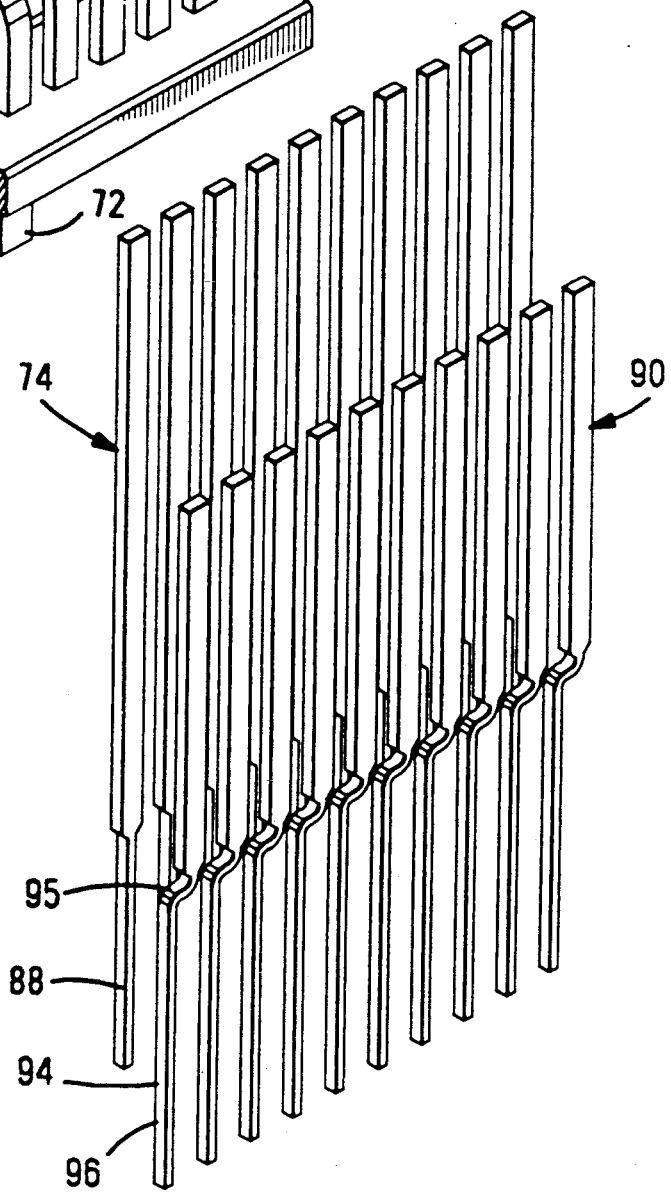
FIG. 8 is a perspective view showing a number of the contact members of the invention, trimmed and formed following one step of the method of the invention.
Figure 6:
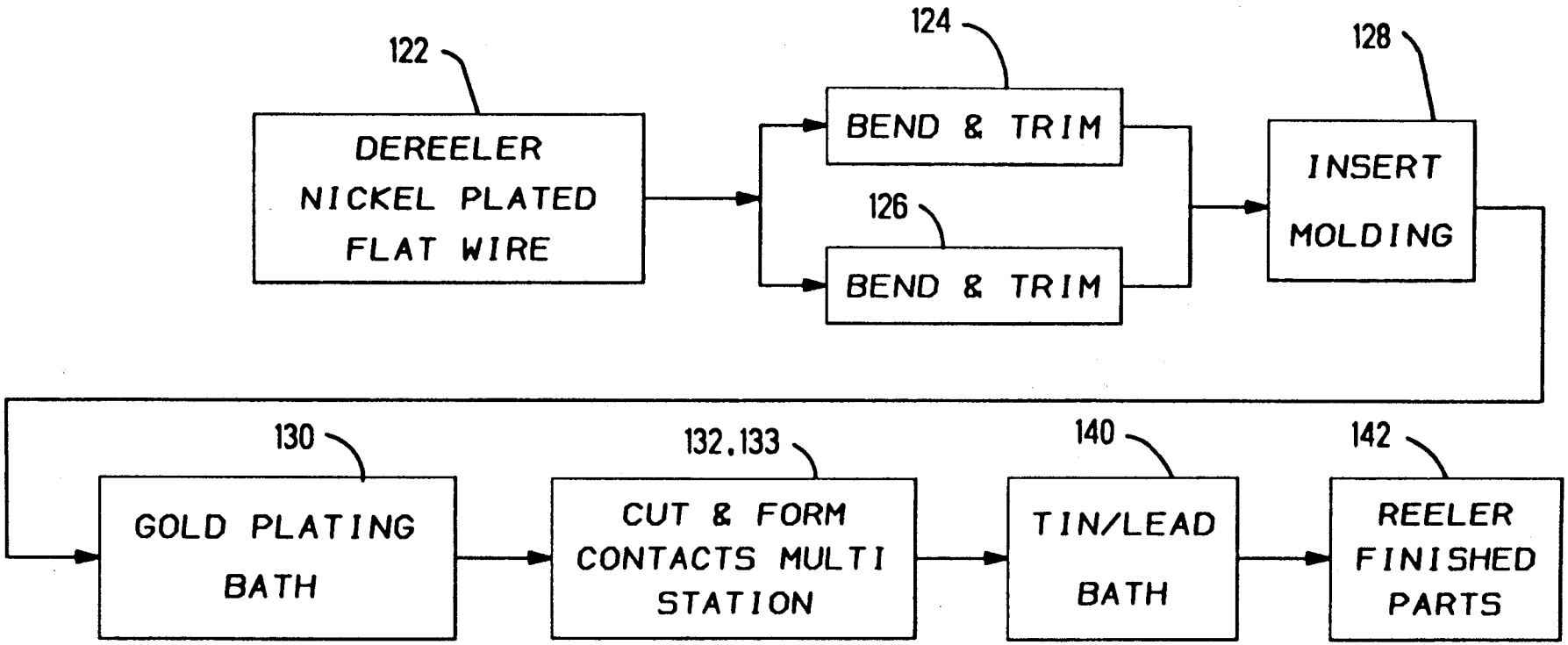
FIG. 6 is a flow diagram showing one embodiment of the method of the invention including the various steps required.
Figure 7:
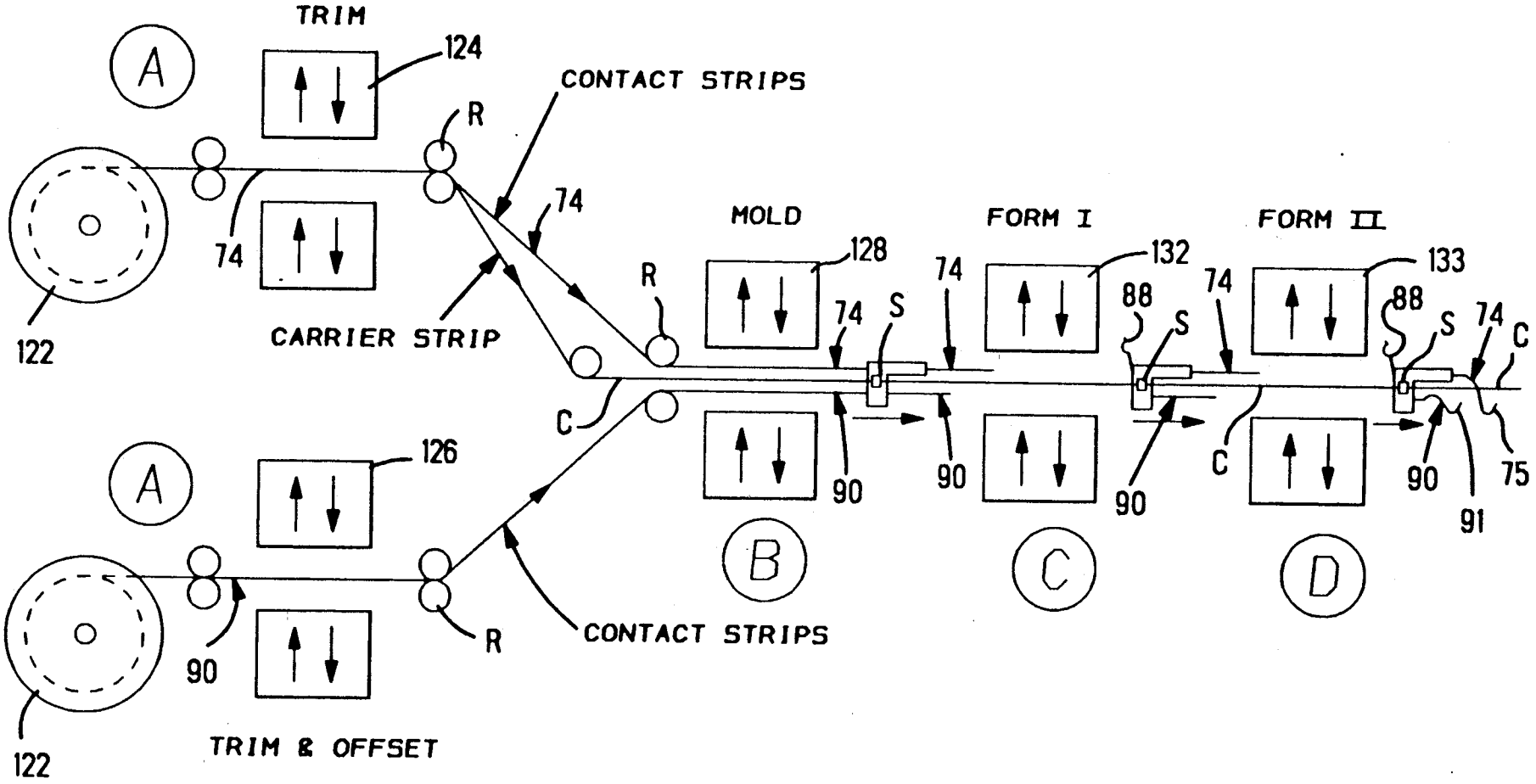
FIG. 7 is a schematic view showing various work stations representing the method steps of the invention.
Figure 11:
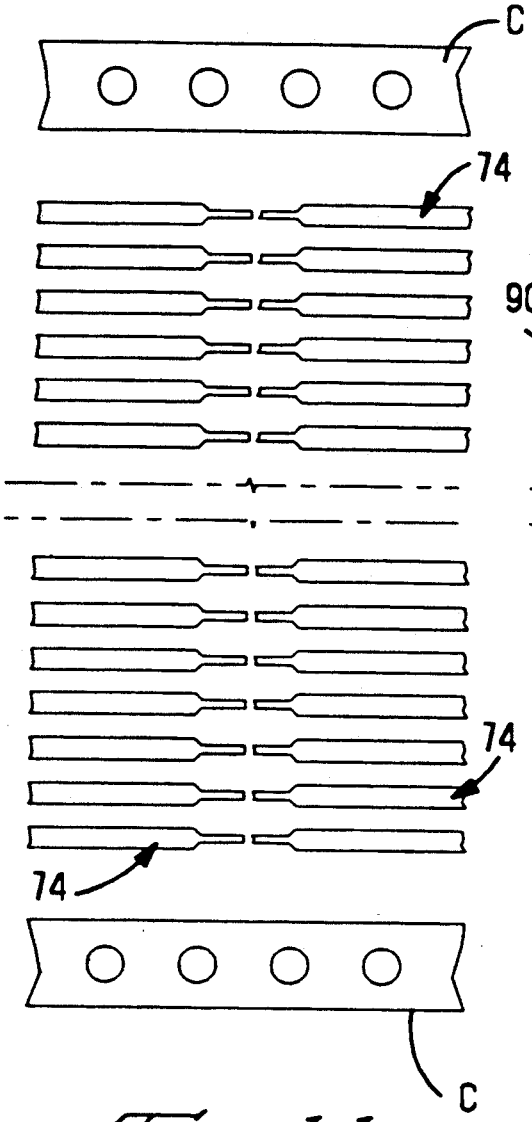
FIG. 11 is a plan view showing a number of contact members following the trimming step of the method of the invention.
Figure 12:
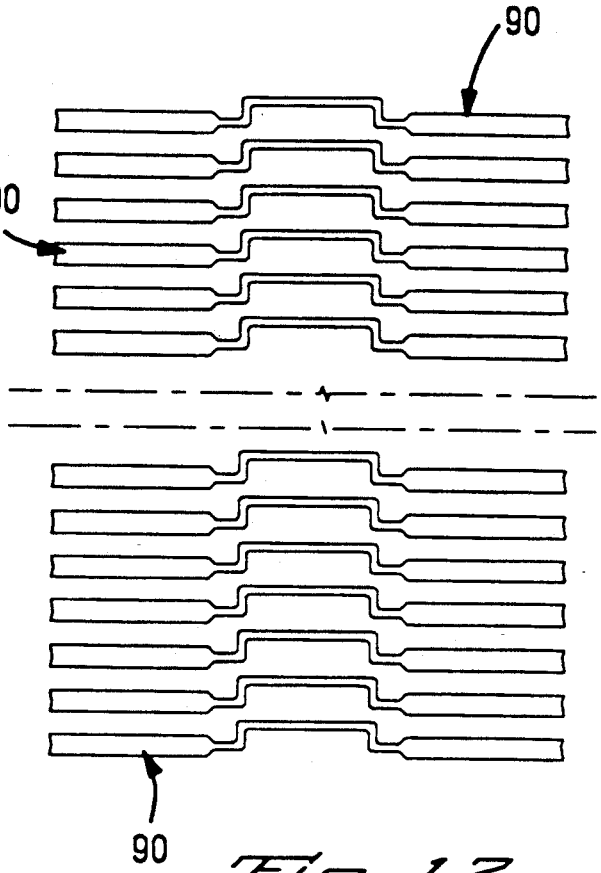
FIG. 12 is a plan view showing a number of the contact members following a forming step of the invention.
Figure 13:
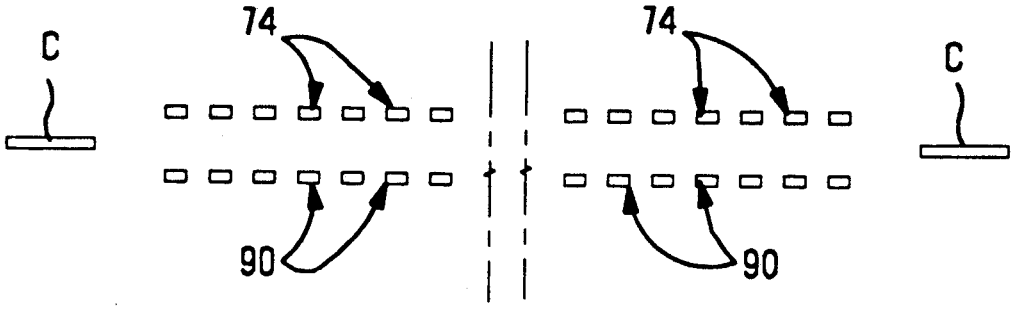
FIG. 13 is a cross-sectional view showing the disposition of contact members relative to a carrier used to transport the contact members of the invention for method steps.

Turning now to the method of the invention, reference is made to the flow chart of FIG. 6, which outlines the process of one embodiment of the invention and the schematic representation of FIG. 7. In FIG. 6, block 122 represents a stage of dereeling multiples of nickel-plated square wire which is typically drawn off of reels of such wire made of spring grade conductive metal such as phosphor bronze or beryllium copper, suitably nickel-plated to provide a barrier coating for subsequent plating of gold as will be described. The wires from 122 are divided and fed by means (not shown) to define an array of upper contacts 74 which are fed through a bend and trim station 124 and the lower contacts 90 which are fed through a bend and trim station 126. These steps are also shown schematically by reels 122 in FIG. 7 at station A and the particular operations can be appreciated by viewing FIGS. 11 and 12, which show the operations of trimming and bending to offset the contact members 74 and 90 respectively. FIG. 8 shows these features of the contact members following trim with respect to the contact members 74 and formed bend at 95 to offset contact members 90. FIG. 13 shows the arrangement in cross-section of the contact members at a point in FIGS. 6 and 7 prior to the mold station 128 or step B and includes the contact members positioned relative to other wires used to form carrier strips C for the assembly, as more fully explained below. The wire for carrier strips C may be made of steel or other suitable materials and are fed from reels (not shown). The various strips of contact members 78,96 and carrier strips C are fed through rollers R to the various stations in the manner shown in FIG. 7.

Figure 9:
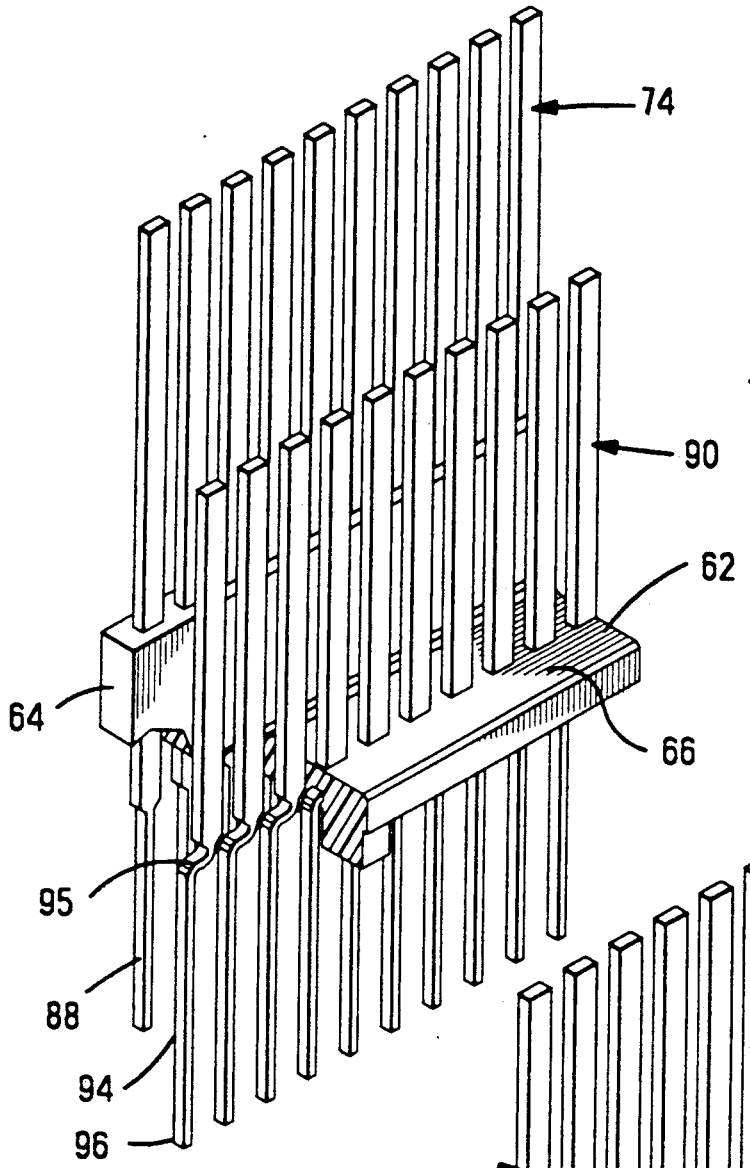
FIG. 9 is a perspective view showing the contact members of FIG. 8 with an added step of molding.
Figures 14, 15, 16, 17, 18:
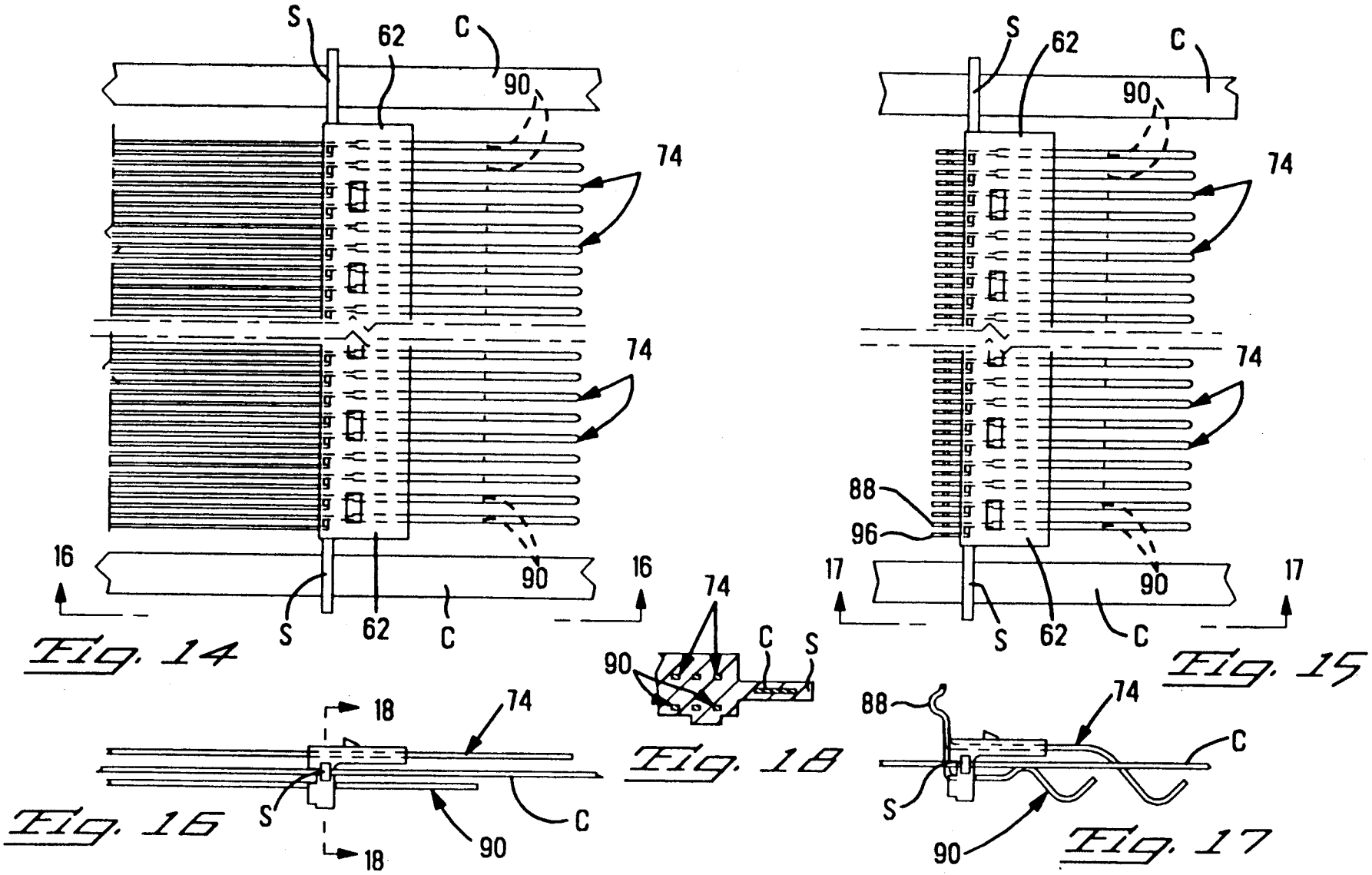
FIG. 14 is a plan view showing the connector of the invention in one stage of formation.
FIG. 15 is a view of the connector of FIG. 14 following deformation and forming.
FIG. 16 is a side view of the connector as shown in FIG. 14.
FIG. 17 is a side view of the connector as shown in FIG. 15.
FIG. 18 is an elevational sectional view of a portion of the connector following the insert molding step.

At the next station or step B, molds illustrated in FIG. 6 as block 128 and in FIG. 7 by mold halves 128 close and open relative to the contacts and the carrier strip C as the various wires move through the molds 128. These molds in effect insert-mold the lower housings, one housing at a time, around the contact members and around the carrier strips C to form a plurality of subassemblies 60 extending along carrier strips C. The result of the molding step is shown schematically and in side view in FIG. 7 and is shown more particularly in FIG. 9. Once molded, the inserts including the contact members 74 and 90, as can be appreciated, are tied to the desirable centerlines by the plastic of the insert molding. Concomitantly with molding the housing around the contact members, the carrier strips C are tied to the contact subassemblies through the extensions labeled S made to envelope the carriers C and thus serve to position the subassemblies for transport to further operations. FIG. 18 shows the carriers embedded in S.

In accordance with one embodiment of the method of the invention and with reference to FIG. 6, the contact members in molded subassemblies 60 are then cut and formed and then plated with gold at 130, preferably selectively at the contact points 78 and 92 and with tin/lead at ends 88 and 96. This may be done by transporting the subassemblies as carried by the carrier strips bound by the plastic of the insert-molding to a plating station of a type capable of plating a small area on contacts A variety of such selective plating processes are known, including forms of belt or brush plating wherein the areas to be plated are brought into contact with belts transporting electrolytes carrying metal ions and with an appropriate current effecting a plateout onto the selected areas. Mask plating can be also employed to this end. The version of the method of the invention utilizing wire forms employs wire which is nickel-plated to form a barrier between the base metal such as phosphor bronze or beryllium copper and the gold to reduce migration, porosity, and other undesirable metallurgical affects. Alternatively, the trimmed and formed wires may be plated prior to the insert molding step.

Figure 10:
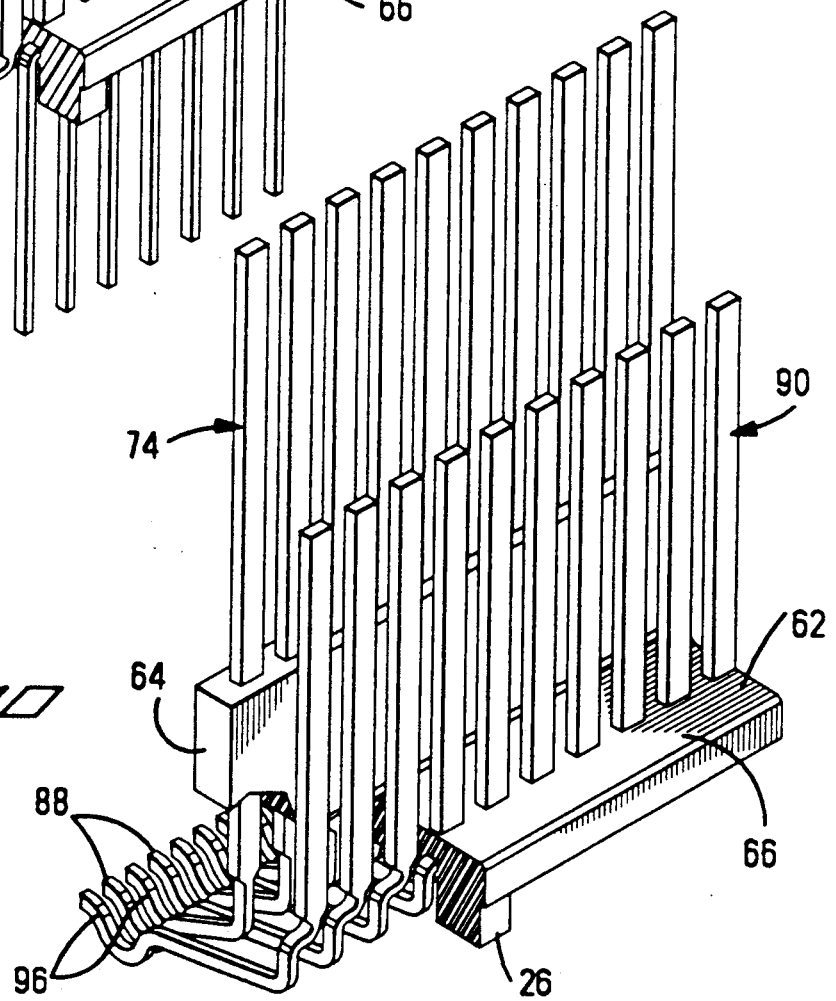
FIG. 10 is a view of the assembly of FIG. 9 with an additional method step of forming.

The method of the invention contemplates a series of steps to cut and form the contact members at such a plurality of forming stations such as Form I at 132 and Form station II at 133 shown in FIG. 7. As can be seen in FIGS. 14 through 17, these steps labeled C and D, respectively, form the solder tabs 88,96 and at the next form the upper ends of contact members 74 and 90. FIG. 10 shows the subassembly after the first forming step and FIG. 5 the subassembly after the second forming step.

As shown in FIG. 6, the invention also contemplates that following the cutting and forming steps, additional plating may be disposed in a selective fashion at a station 140, thereafter the subassemblies still tied to the carriers C, may be reeled as finished parts for subsequent assembly and use.

The invention further fully contemplates substitution and alternative methods of forming the contact members at the forming stations 132 and 133 following the molding station 128 as indicated in FIG. 7 and prior to the plating station 140 as shown in FIG. 6. This is particularly of advantage with respect to certain types of gold plating that will not withstand the bending and forming of the contact members following plating. The invention fully contemplates a variety of uses for the various steps depending upon the particulars of the connector.

Figures 19, 20, 21:
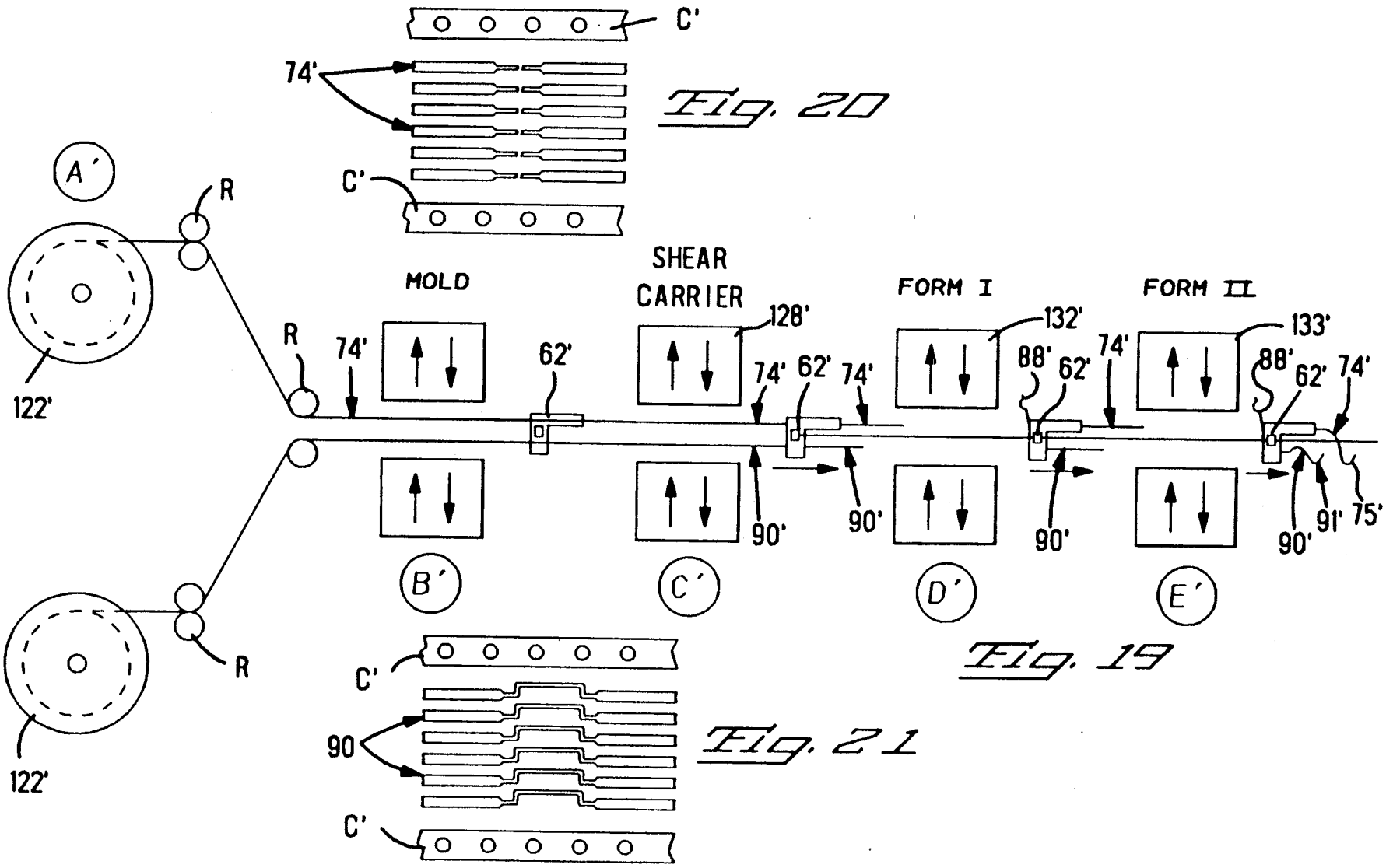
FIG. 19 is a schematic view of an alternative method of the invention showing the various processing steps for the alternative method.
FIG. 20 is a plan view of a portion of the contact members of the invention preparatory to the insert molding step.
FIG. 21 is a plan view of contact members of the invention also preparatory to the molding step of the invention.

FIG. 19 shows one alternative method, which employs a preformed contact array which is suitably stamped and formed to provide contact members 74' carried by a carrier C' which interconnects all of the contact members in an initial process stage. These contact members 74' are shown in FIG. 20 and are reeled on a reel 122' to be fed by rollers R throughout the process. The contact members 90' have a preform as shown in FIG. 21 and are reeled on reels 123' through rollers R to the subsequent stations. The steps A', B', C', D' and E' represent the different method steps. Thus, there is a mold station 128' which effectively molds the insert lower housings 62' followed by a shearing of the metal carriers of one of the strips, the width of carriers C' in this embodiment being varied as between contact members 74 and contact members 90' to facilitate a ready shearing of one or the other carriers along with the carriers in between the contact strips which are blanked out at station 129. At this time, one or the other carriers is utilized with the insert moldings locked to such carriers in the manner heretofore described. At a station 132' the solder tabs such as 88' are formed, and at a station 133' the contact portions 75' and 91' are formed.

The invention as thus far described illustrates the use of wire forms which are processed in multiple to form connectors, the lower halves of connectors in the present example or it uses stamped and formed metal parts to form contact members and connectors in a similar process. As can be discerned, in accordance with the invention, insert molding is achieved on two rows of contact members, which subsequently have different physical geometries to perform functions of interconnection. The invention fully contemplates that in certain designs and operations, a row of the contact members may be stamped and formed with a subsequent or further row formed of drawn wire, depending upon the economies of use and the particular geometries required. Thus, for example, contact members having geometries that do not lend themselves to deformed drawn wire may be stamped and formed with contacts having less demanding geometries being formed of wire and with both contacts utilized in an insert molding and forming process like that of the invention.

Having now described the invention in terms intended to enable a preferred practice of the method thereof, claims defining the invention are set forth as follows.

We claim:

1. In a method of manufacturing electrical connectors of the type having rows of contact members each including resilient spring arms defining contact areas adapted to engage the contact pads of further circuits wherein said contact members are held in a plastic and insulating housing in said rows on given centers the steps comprising:

a. feeding a plurality of contact members in a form essentially continuously to a mold station;
b. providing a carrier strip at such mold station and molding a housing around said contact members intermediate the ends thereof and integrally molding around said carrier strip define a means of transporting said housing for further processing;
c. trimming said contact members after said housing is molded to provide a discontinuous length of contact members of a desired length for each housing;
d. forming said trimmed contact members to provide said resilient spring portions; and
e. severing said contact members and housings from said carrier strip to individualize said assembly connectors.

2. The method of claim 1 characterized in that said step of feeding a plurality of contact members comprises feeding a plurality of drawn wires.

3. The method of claim 1 characterized in that said step of feeding a plurality of contact members comprises feeding a plurality of contact members stamped and formed from conductive sheet metal stock.

4. The method of claim 1 characterized in that said step of feeding contact members includes feeding two rows of contact members in parallel.

5. The method of claim 1 characterized in that there is an additional step preceding said step of feeding comprising a step of trimming and forming said contact members prior to molding.

6. The method of claim 1 characterized in that there is an added step following said step of forming said contact members including plating said contact members.

7. The method of claim 1 characterized in that there is an additional step following said step of forming said contact members comprising gold plating said contact members at one end thereof and a further step following said forming step of coating said other end of said contact members with a solder material.

8. A method of manufacturing electrical connectors of a type having multiple contact members positioned in parallel rows and including portions adapted to engage further contact paths at each end thereof with at least one of said ends being resilient to provide deflection to define a stable electrical interface including the steps:

a. providing an array of contact members extending in essentially a plane on common centers,
b. closing a mold on said array of contact members and molding a plastic therearound forming a housing with the ends of said contact members extending freely from said housing,
c. simultaneously with said molding of plastic joining said housing material to a carrier strip provided adjacent said housings to transport said housings for further processing,
d. severing said contact members to a desired length,
e. forming said contact members to provide said resilient ends, and
f. severing the said carriers from said housings to particularize said housings and said contact members as connector elements.

9. The method of claim 8 wherein there is included an additional step of plating said contact members following the step of forming.

10. The method of claim 8 including the additional step of providing a carrier means and molding around said carrier to lock said insert molding housing thereto for transport of the connector for subsequent processing.

11. The method of claim 12 including the step of severing said connectors from said carrier means to particularize said connectors.

12. A method of manufacturing electrical connectors of a type having multiple contact members positioned in parallel rows including contact portions adapted to engage further contact paths at the ends thereof including the steps:

a. providing a first and second arrays of contact members overlying one another with each array extending in a common plane on common centers,
b. closing a mold on said arrays and insert molding simultaneously a housing about both arrays with contact elements extending free of said mold to form a housing carrying said contact members, c. trimming the ends of said contact members to define contact members of a desired length, and d. forming said contact members at each end to define contact elements extending in a common plane adapted to engage further contact paths at each end of the contact members.

13. The method of claim 12 wherein there is included the step of plating said contact members following said step of forming.

14. The method of claim 12 wherein said step of forming includes forming one end of the contact members to lie in a plane with the contact members of that end.

15. The method of claim 12 wherein said step of forming includes forming both ends of the contact members so that common ends lie essentially in common planes.

16. The method of claim 12 wherein said step of forming includes interdigitating one end of the contact members.

* * * * *